United States Patent [19]

Lark

[11] 4,073,993

[45] Feb. 14, 1978

[54] HYDROPHILIC FINISHING PROCESS FOR HYDROPHOBIC FIBERS

[75] Inventor: John C. Lark, St. Charles, Ill.

[73] Assignee: Standard Oil Company (Indiana), Chicago, Ill.

[21] Appl. No.: 752,518

[22] Filed: Dec. 20, 1976

Related U.S. Application Data

[63] Continuation-in-part of Ser. No. 560,503, March 20, 1975, abandoned.

[51] Int. Cl.[2] ..... B05D 3/02; B32B 27/06; B32B 27/34; B32B 27/36

[52] U.S. Cl. ..... 428/261; 427/390 E; 428/272; 428/480; 428/482; 428/474

[58] Field of Search ..... 427/390 E; 428/272, 428/261, 480, 482, 474

[56] References Cited

U.S. PATENT DOCUMENTS

| | | | |
|---|---|---|---|
| 2,629,701 | 2/1953 | Ericks | 427/390 X |
| 2,917,410 | 12/1959 | Vitalis | 427/390 X |
| 2,920,980 | 1/1960 | Mooberry | 427/390 X |
| 3,836,390 | 9/1974 | Barber et al. | 427/390 X |

*Primary Examiner*—Michael R. Lusignan
*Attorney, Agent, or Firm*—William C. Clarke; Arthur G. Gilkes; William T. McClain

[57] ABSTRACT

A process of treating textiles and textile fibers with a partial ester having at least one retained acid group to impart a durable hydrophilic antistatic antisoiling finish which comprises the steps of (1) providing a water-soluble reaction product of a polyethylene glycol of an average molecular weight of 100 to 6000 and a polycarboxylic acid compound capable of forming a four to six membered cyclic acid anhydride ring, (2) coating, and (3) curing said reaction product on said textiles and textile fibers.

14 Claims, No Drawings

HYDROPHILIC FINISHING PROCESS FOR HYDROPHOBIC FIBERS

BACKGROUND OF THE INVENTION

This application is a continuation-in-part of application Ser. No. 560,503, filed Mar. 20, 1975, now abandoned.

The field of this invention relates to a fabric coating process to modify the surface properties of polyester and nylon fibers so as to improve their hydrophilic characteristics with consequent improvement in antisoiling and antistatic properties under standard laundering conditions.

Many synthetic polymers such as polyesters, polyamides and polyolefins which are utilized as fibers suffer from the problem that they are relatively hydrophobic, that is, they lack an affinity for water and are relatively unable to either absorb or transport moisture along the surface of the fiber. This characteristic of hydrophobicity has been a persistent problem in the utilization of these synthetic fibers for the manufacture of garments. For example, a hydrophilic surface, i.e., a surface having a strong affinity for water, is particularly important in the manufacture of garments such as shirts and undergarments where rapid transmission of moisture is an asset. Hydrophobic fibers, if used for such garments, cause a cold, clammy feeling and a degree of discomfort to the wearer. Lack of moisture transmission also results in lack of breathing of the fabric which is attended by the wearer's tendency to assume the fabric is harsh and hard on the skin.

Hydrophobic properties of a fiber are also well-known as affecting its antistatic and antisoiling properties. Hydrophobic fibers when formed into shaped textile articles tend to accumulate static charges with a propensity to accept and retain grime and dirt. Synthetic hydrophobic fibers also tend to be oleophilic. Therefore, should oil and grime become embedded in the fiber, its hydrophobic properties tend to prevent water from entering the fiber to remove the contaminates therefrom. The difficult problem of cleaning oleophilic fibers makes desirable the modification of these properties to permit entrance of water for ease of cleaning.

A substantial amount of research has been performed in the textile industry to overcome the problem of the hydrophobic nature of these fibers by modifying their surface properties with a durable hydrophilic finish with attendant improvement in antistatic and antisoiling characteristics.

An example of a textile hydrophilic treatment process which functions by applying a polymeric coating is found in U.S. Pat. No. 3,236,685 to Caldwell et al. The polymeric coating adheres to the fiber by cross-linking a high molecular weight coating which provides a structured composition with an insoluble exterior that has the desired hydrophilic properties under conditions of wearing and laundering. The process described in this patent provides a hydrophilic insoluble coating having antistatic and antisoiling properties by coating the fabric with a solution or solutions containing a polyhydric alcohol and addition polymers of $\alpha$, $\beta$-ethylenically-unsaturated acids. Under the proper conditions, the polyhydric alcohol reacts with the aliphatic polyacid to partially cross-link the polymer to provide an external coating of the fiber. The patentee states that ester linkages are formed to provide a partially cross-linked, flexible polymeric material which functions very much as an ion exchange resin. The polymeric polybasic acid is cross-linked to the extent that it is no longer soluble but some of the acidic ions are available to furnish ions for conducting static charges. The esterification is necessary to provide an insoluble coating with durability to standard laundering conditions. The patentee states the hand of the fabric is affected by the amount of the polymeric additive applied so a minimum amount consistent with effective surface characteristics is desirable.

Another example of a textile treatment process which improves the antistatic and water-absorption properties of the fiber is found in British patent specification No. 1,358,195 to Brokmeier et al. This process modifies the polymer composition to attain the desired properties. Acrylonitrile polymer compositions are rendered antistatic and hydrophilic by the incorporation within the polymer composition of antistatic compounds which are miscible in polyacrylonitrile spinning solutions. This system imposes an added requirement on the spinning solution, that it be miscible with the antistatic compound. The additives are processed into the fibers and as much as 20% by weight of the polymer is additive.

There is a demand therefore for new approaches to this problem of modifying the hydrophobic properties of fibers to improve their hydrophilic, antistatic and antisoiling characteristics which permit the avoidance of the defects in the present methods used. As mentioned, the cross-linking polymeric approach can affect the hand of the material if more than minimum quantities are used. The incorporation of the surface modifying additive into the polymer through the spinning solution as in British patent specification No. 1,358,195 requires that the additive be miscible with spinning solution. The British patent specification states that quantities of additive up to 20% of the polymer weight are to be utilized, which represents a relatively large use of additive.

The general object of this invention is to provide a simple process for treating polyester and nylon fibers, and combinations thereof with cotton, so as to improve the hydrophilic properties of these fibers. Another object is to obtain these improved properties with minimum modification of the hand of the material. Another object is to provide a process which utilizes the treating additive at a low level of application, thus obtaining an economic, efficient rate of use of the treating additive. Other objects appear hereinafter.

I have now found that the process of coating polyester and nylon fibers with mono and diesters of aliphatic and aromatic polybasic acids and polyethylene glycols improves the hydrophilic properties of these fibers. These partial esters were at least one retained acidic group cure onto the polyester and nylon fiber surfaces during a cure cycle to give a durable hydrophilic, antistatic, antisoiling textile finish. The modification of these surface properties occurs without excessive impairment of the critical properties of the coated fabric such as hand. The treating additive is applied at a low level, representing an economic, efficient rate of use.

SUMMARY OF INVENTION

Fabric coating process for polyester and polyamide fibers improves hydrophilic, antistatic and antisoiling properties of fabrics made of these fibers. The process uses mono and diesters of aliphatic and aromatic polybasic acid compounds and polyethylene glycols wherein at least one acidic group is retained on the aliphatic or aromatic moiety after the esterification. The partial esters are cured onto the fiber surfaces to give a durable hydrophilic textile finish under standard laundering conditions.

DESCRIPTION OF THE PREFERRED EMBODIMENTS

It has been found, in accordance with this invention, that the process of coating partial esters onto polyester and polyamide fabrics surprisingly modifies the surface properties of these fibers so as to improve their hydrophilic characteristics.

Polyester and nylon or polyamide fabrics are all well-known textile fibers and textiles. For purposes of this invention, the term "polyester" is defined as including the highly-polymeric fiber and film-forming linear polyesters derived from at least one aliphatic, cycloaliphatic, or aromatic dicarboxylic acid and at least one aliphatic, cycloaliphatic, or aromatic diol. The term "nylon" or "polyamide" is defined as including the highly-polymeric fiber and film-forming polyamide polymers characterized by the presence of the amide group —CONH.

For purposes of this invention, polyethylene glycol is defined as a polyol which is a water-soluble polymer of ethylene oxide having the formula $H—(OCH_2CH_2—)_n—OH$ where $n$ is an integer from 2 to approximately 150. Examples of suitable polyethylene glycols include diethylene glycol, triethylene glycol, tetraethylene glycol, etc. Other suitable polyethylene glycols are the Carbowaxes supplied by the Union Carbide Corporation. As is well-known, the hydrophilic characteristics of the polyethylene glycols are determined by molecular weight and chain length.

For purposes of this invention, the term "partial ester" is defined as an ester derived from a polycarboxylic acid compound and a polyol wherein the polycarboxylic acid compound retains at least one unreacted carboxyl group on the molecule after the esterification. It is essential for purposes of this invention that one carboxyl group be present upon the esterified molecule for reaction with the fiber surface by means of the free hydroxyls or amino groups present in the fiber surface to provide durable attachment to the fiber. The partial esters of this invention can be produced by the method disclosed by patentee Ericks in U.S. Pat. No. 2,629,701 which is incorporated by reference.

The partial esters can be the mono and di-esters of polycarboxylic acid compounds which form acid anhydrides and polyethylene glycols of molecular weights from approximately 100 to 6000. It is essential for purposes of this invention that the polycarboxylic acid compound be one which forms an anhydride as the formation of the partial ester requires that a low heat be applied to the reaction, preferably between the range of 130° to 175° C, so that complete esterification of the carboxyl groups on the molecule does not occur. Polycarboxylic acid compounds which do not form acid anhydrides require a higher level of energy or heat to react. The higher temperature required to esterify these compounds generally leads to an undesirably high concentration of fully esterified acid. It is further essential that the polycarboxylic acid compound be one which is capable of forming a four to six membered cyclic acid anhydride ring. A non-cyclic acid anhydride such as acetic anhydride would upon esterification form the monoester only and a separate molecule of the acid.

Examples of the polycarboxylic acid compounds which form acid anhydrides and which are suitable for the partial esters required for the purposes of this invention are, among others, trimellitic acid, phthalic acid, pyromellitic acid, maleic acid, succinic acid, adipic acid, glutaric acid, naphthalic acid, prehnitic acid, etc., and the anhydrides of these acids. The polycarboxylic acid compounds can be substituted with halogen and other radicals without impairing the hydrophilic and soil release properties of the fabric coating.

Preferably the aromatic polycarboxylic acid compounds are the benzene and naphthalene di, tri, and quatercarboxylic acids and acid anhydrides having two to four carboxyl groups bonded directly to the aromatic ring moiety wherein the compound is capable of forming a four to six membered cyclic acid anhydride ring. Among the aromatic acid compounds which are most preferred are trimellitic and pyromellitic anhydrides and their acids. Preferably the aliphatic polycarboxylic acid compounds are polycarboxylic acids and anhydrides having two to four carboxyl groups bonded to a carbon chain of from two to ten carbons wherein the compound is capable of forming a four to six membered cyclic anhydride ring. Among the aliphatic acid compounds which are most preferred are maleic anhydride and maleic acid.

Preferably the partial esters of this invention are the mono and diesters of polyethylene glycols of molecular weights from approximately 100 to 2000. The monoesters are the preferred finishing agents. The preferred ester for hydrophilicity is the monoester of a trimellitic acid compound and the polyethylene glycol of molecular weight of approximately 1500. The preferred ester for soil release is the monoester of a trimellitic acid compound and the polyethylene glycol of molecular weight of approximately 600. The preferred add-on levels are 0.1 to 4% of the fabric weight.

For purposes of this invention, the monoesters demonstrating hydrophilac and soil release behavior are characterized as having acid numbers within the range of 17 through 286, preferably 65 to 75 for hydrophilic behavior, and preferably 135 to 145 for soil release behavior. Diesters demonstrating hydrophilic and soil release behavior are characterized as having an acid number within the range of 4 through 95, preferably 14 to 20 for hydrophilic behavior and preferably 35 to 45 for soil release behavior. The monoesters are further characterized as those esters with above said acid numbers and hydroxyl numbers 8 through 140 and preferably within the range of 35 to 40 for the hydrophilic agent and 65 to 75 for the soil release finish. The diesters are further characterized as those esters with above said acid numbers and hydroxyl numbers of zero.

The nomenclature utilized to describe the mono and diesters of this invention is A-B-N, where A is the molecular weight of the polyethylene glycol, B is the name of the acid anhydride used, and N is the moles of anhydride used per mole of polyethylene glycol. For example, 600-TMA-1 indicates a polyethylene glycol with a molecular weight of 600 which was esterified with one mole of trimellitic anhydride (TMA).

While I do not desire to be bound by any theory concerning the mechanics of the coating process of this invention, it is theorized that the retained acidic group of the monoester and diester reacts preferentially with the fiber surface by means of free hydroxyls or amine groups present on the fiber surface rather than with the single free hydroxyl group available on one end of the ester. The resulting hydrophilic layer of the ester coating modifies the surface of the coated fiber to render the surface hydrophilic to reduce the deposition of oily dirt and to ease the dissipation of static charges. Inferential evidence of this reaction with the free hydroxyls present on the fiber surface was given by infrared analysis of the finishing agent which indicated the presence of an ester before the curing step. Acid numbers and hydroxyl numbers of the ester indicated the presence of acid and hydroxyl groups. The hydrophilicity of the cured finish on the fiber indicated the continued presence of the hydroxyl groups.

For example, the TMA monoesters of polyethylene glycol 600 and 1500 were examined by gel phase chromotography (GPC) to separate the esters and by infrared analysis to identify the separated materials. Acid and hydroxyl numbers established the presence of free carboxy groups and hydroxyl groups.

Monoesters of the 600 and 1500 molecular weight polyethylene glycols were prepared by heating trimellitic anhydride with the said glycols in mole ratios of 1:1. Acid number determinations were made during the period of the reaction in an acetone/water mixture to measure the disappearance of the anhydride group. After approximately one hour, the unchanging acid number determinations indicated the monoesterification was virtually complete; however, the materials were heated for another four hours at 150° C to insure the reaction was complete. The acid numbers during the additional four hours were virtually unchanged.

Samples of the 600-TMA-1 and 1500-TMA-1 were run with suitable blanks of 600 and 1500 polyethylene glycols through gel-phase chromotography procedure using a Waters Model 200 to obtain molecular separation of the ester samples. Essentially one peak resulted which indicated virtually 100% conversion to the monoester in each case without the presence of higher molecular weight eligomers. The reaction conditions of low temperature within the range of 140° to 150° C without a catalyst in the case of the trimellitic anhydride and polyethylene glycol served to preferentially produce the monoesters.

Fractions of the high molecular weight peak samples of the gel-phase chromatograph procedure were collected. By infrared analysis, the trimellitic acid radical was found to be present in the peak, indicating a chemical bond rather than a mixture. Two peaks would have been present for a mixture, i.e., a polyethylene glycol peak and a trimellitic anhydride peak. Determination of the acid number, hydroxyl number and empirical molecular weight followed, according to the following empirical formula:

$$\text{Empirical molecular weight (average)} = 1000/(x\text{-}a)(y\text{-}b) \text{ times } 2$$

where:

$x$ is Acid Number/56.1

$a$ is a number of moles of trifunctional acid in a 1000 gram resin batch $y$ is Hydroxyl Number/56.1

$b$ is number of moles of trifunctional gylcol in a 1000 gram resin batch 56.1 is molecular weight of potassium hydroxide (KOH)

Acid number is milligrams of KOH per gram of sample

Hydroxy number is milligrams of KOH per gram of acetylated sample.

$a$ is 1.26 for TMA $b$ is zero for polyethylene glycol.

The acid and hydroxyl numbers measured on the 600-TMA-1 material were as follows:

Acid Number — 138–143

Hydroxyl Number — 66.9–73.2

Theoretical Acid Number — 141

Theoretical Hydroxyl Number — 70

These measured numbers corresponded to an empirical molecular weight (average) of 800. Theoretical molecular weight for this molecule is 792.

The mono- and diesters of the examples were prepared by heating the two reactants together in the desired mole ratio, one to one, or two to one, at approximately 140° C for a period of one hour. The temperature was then increased to approximately 150° C (range of 130° to 155° C) for four hours to insure a complete reaction. The acid numbers were monitored to observe the course of the reactions.

The resulting mono- and diesters resulting were tested as finishes on clean, undyed fabrics obtained from Test Fabrics, Inc., Middlesex, N.J. Finish levels of 1% and 4% (solids) were tested on the weight of the goods (owg) by coating the fabric with the appropriate solution to 100% wet pick-up. pH levels of 5.5 and 9.5 were used on 100% polyester fabric and 100% nylon 6/6 fabric to determine if the pH of the solution was important. The treated fabric was subjected to a dry/cure cycle of 5 minutes at 120° C. and 5 minutes at 150° C.

Fabrics treated and tested were 100% polyester, 65/35 and 50/50 polyester/cotton, and 100% nylon or polyamide. All fabrics were from spun yarns in the 70 × 72 construction range. The cotton containing items were also treated with a durable press resin (Permafresh 183) at 15% owg level in a one batch application. Citric acid was substituted as the resin cross-linking catalyst due to the formation of an insoluble magnesium-TMA ester precipitate in the presence of the standard catalyst magnesium chloride.

Improvement of hydrophilicity characteristics of a polyester fiber has been demonstrated with monoesters of polyethylene glycol as low as 400 molecular weight but a polyethylene glycol molecular weight of approximately 1500 has been found to be preferable.

Increase in the hydrophilicity of polyester fiber were measured by two different tests. The first was the American Association of Textile Chemists and Colorists (AATCC) Standard Test Method 39-1971, Evaluation of Wettability. This test provides for a rapid evaluation of the wettability of a fabric by measuring the length of time that a drop of water remains upon the surface of the test fabric. A readily absorbent material wets instantly in this test, as for example a prepared cotton print cloth, or boiled and bleached linen.

The details of the test are that a drop of water is allowed to fall from a fixed height onto a test surface of a test specimen. The time required for the specular reflection of the water to disappear is measured and recorded as wetting time. The apparatus used consists of an embroidery hoop, a buret delivering 15 to 25 drops of water per milliliter, and a stop watch. A swatch of goods to be tested is spread over the hoop. The textile is previously allowed to condition at 65 ± 2% relative humidity and at 70 ± 2° F. (21 ± 1° C.) for at least 4 hours before being subjected to the test. The buret is adjusted so that it delivers one drop of water at 70 ± 3° F. (21 ± 3° C.) approximately every 5 seconds. The buret is positioned approximately ⅜ inch (1 cm.) above the textile and the stop watch is started as the drop falls. The watch is stopped when the liquid on surface of the textile loses its specular reflective power. Readings of wetting time are made so easily and quickly that ten can be taken and averaged. The shorter the average wetting time, the more readily wettable is the textile.

The second test utilized in the evaluation of hydrophilicity improvement is a wicking behavior test used in the industry but which has not been adopted as a standard test by AATCC. In this test a 1½ inch (3.8 cm.) strip of fabric is cut in the warp direction and weighted with a glass rod weighing 2.0 grams, ¼ in. in diameter, 1½ in. in length. One end of the fabric is then immersed in a solution containing blueing and allowed to remain in the solution for a period of 45 minutes. The blueing solution is prepared by mixing 0.5–1.0% household blueing solution in water. At the end of the 45 minute period, the sample is removed from the blueing solution and the distance which the blueing solution has wicked up the fabric is measured in centimeters.

All fabric utilized in the wicking tests had been laundered five times (5×) in a Kenmore automatic washing machine Model 600 using standard cycles of 12 minutes with detergent plus one complete cycle without detergent. The detergent was AATCC standard detergent.

Soil release activity was demonstrated with monoesters of polyethylene glycol as low as 100 molecular weight. Soil release activity becomes significant at 400 molecular weight and has been demonstrated with polyethylene glycol esters to 6000 molecular weight. The mono-TMA ester of polyethylene glycol 1500 molecular weight appears to be more active than the di-TMA ester of the polyethylene glycol 1500 molecular weight. It was also demonstrated that the polyethylene glycol of 1500 molecular weight is not as active in soil release activity as the 600 molecular weight polyethylene glycol ester. The durability of the aliphatic maleic anhydride adduct of polyethylene glycol 600 molecular weight is questionable after approximately 50 laundry cycles.

The ability of a finish to release a stain which has been set into a fabric was measured by the AATCC Test Method 130-1970, Soil Release: Oily Stain Release. This test is designed to measure the ability of a fabric to release oily stains during home laundering. A stain is forced into the fabric substrate by a five-pound weight for a period of one minute. Retention of the stain on the fabric is rated on a 1 (low) through 5 (high, no stain remaining) scale after a standard laundering cycle. Finish durability is measured by restaining the fabric after five standard laundering cycles and measuring release with another laundering cycle. Additional stains other than the standard stain of mineral oil were applied to the test specimens using the standardized techniques.

The test results indicate that optimum results in terms of said release activity have been obtained with the polyethylene glycol ester of trimellitic anhydride, phthalic anhydride, and maleic anhydride in which the polyethylene glycol unit is approximately 600 molecular weight. The mono-anhydride adducts of the polyethylene glycols have been demonstrated to provide higher activity than the corresponding diester. The initial activity of the polyethylene glycol esters of trimellitic anhydride (TMA), phthalic anhydride (PAN) and maleic anhydride (MAN) appears to be equivalent. However, the durability of the aliphatic anhydride MAN does not appear to be quite as good as the aromatic anhydrides TMA and PAN. No advantage was noted on durable press resin treated polyester-cotton blends. The effect of the durable press resin overshadowed the effects of the soil release finish.

The fabric coating process of my invention improves the hydrophilic, antistatic and antisoiling properties of polyester and nylon fibers, and combinations of these, and with cotton blends thereof. The process uses the mono and diesters of polycarboxylic acids capable of forming a four to six membered cyclic acid anhydride ring. The partial esters of these polyacid compounds and polyethylene glycols of molecular weights from 100 to 6000 are coated, in the process of my invention, onto the fabrics thorugh a water solution of these partial esters to a complete wetout. The fabrics are put through a standard padder and the excess coating solution squeezed from the fabrics by the rubber rolls achieving a wet pickup of 100%, to double the weight of the dry untreated fabric. The wet fabrics are then dried and the partial ester is cured onto the fabric by heat.

The coating add-on levels on the fabric can range between 0.1 to 8% of the fabric weight. Curing of the partial esters onto the fabric by application of heat within the range of from 130° to 170° C for a period ranging from 5 to 30 minutes results in a durable hydrophilic textile finish which withstands standard laundering conditions.

In summary, my invention consists of a process of treating textiles and textile fibers with a partial ester having at least one retained unreacted acid group on the molecule after the esterification to impart a durable hydrophilic antistatic antisoiling finish and articles comprising textile fibers and textiles carrying said finish, which process comprises the steps of (1) providing a water-soluble reaction product consisting essentially of a polyethylene glycol of an average molecular weight of 100 to 6000 and an aromatic polycarboxylic acid compound having two to four carboxyl groups bonded directly to the aromatic moiety wherein the compound is capable of forming a four to six membered cyclic acid anhydride ring, wherein the mole ratios are within the range of 1:1 to 1:2, glycol to acid, the reaction temperature of said glycol and said acid being within the range of from about 130° to 175° C, the said partial esters being characterized by acid numbers within the range of 17 through 286 when said ester is a monester and 4 through 95 when said ester is diester, (2) coating, and (3) curing said reaction product on said textile and texile fibers, the said textiles and textile fibers being selected from the group of textiles and textile fibers consisting of polyesters, polyamides and polyester-polyamide blends. The aromatic polycarboxylic acid compounds can be selected from the group consisting to trimellitic acid, trimellitic anhydride, pyromellitic acid, pyromellitic anhydride, phthalic acid, and phthalic anhydride.

In order to facilitate a clear understanding of the invention, the process of coating the textiles with mono- and diesters of polyethylene glycols and organic dibasic acid anhydrides to impart a durable hydrophilic antisoiling finish to polyester fibers and fabrics, the following specific embodiments are described in detail. It should be understood, however, that the detailed expositions of the application of these materials, while indicating preferred embodiments, are given by way of illustration only since various changes and modifications within the spirit and scope of the invention will become apparent to those skilled in the art from this detailed description.

EXAMPLE I

The reaction products of trimellitic anhydride (TMA), phthalic (PAN), maleic anhydride (MAN) and polyethylene glycol (PEG) (obtained as diethylene glycol and Carbowax 200 through 6000 from Union Carbide Corporation) were prepared by heating the desired mole ratio of the two reactants at 140° C. for a period of one hour. As a typical example of the preparation of the polyethylene glycol adducts of the organic dibasic acids, the following preparation of the PEG adduct of TMA is given.

76.8 Grams (0.4 moles) of trimellitic anhydride (TMA) and 240 grams (0.4 moles) of polyethylene glycol of molecular weight 600 (Carbowax 600) were mixed in a one-liter resin kettle equipped with heating mantle, mechanical stirrer, nitrogen sparge, thermometer and vent tube. The temperature was raised to 135°-150° C. over a period of one hour with mechanical stirring. The reaction mass was maintained at a temperature of 140°-150° C. for a period of four hours. The product was then cooled and stored. In the case of the TMA-Carbowax 600 product, the final product was a thick paste heavier in viscosity than the liquid Carbowax 600 used to prepare the product.

The 1% coating or finishing bath solution was prepared by measuring into a tared beaker containing a magnetic stirring bar 3.0 grams of the TMA adduct of Carbowax 600 and 150 grams of deionized or distilled water. To this mixture, approximately 3.0 grams of 5% sodium hydroxide solution was added with magnetic stirring. The resulting mixture was stirred at room temperature until dissolution of the TMA adduct was complete. The resulting pH was very high, above 12. Glacial acetic acid was added drop-wise to this mixture until a pH of 5.5 was attained. Additional water was added until a total mixture weight of 300 grams was obtained. The pH was adjusted again to 5.5.

In a similar manner, polyethylene glycol partial esters of polybasic acids with a retained acid group were prepared. One mole of polyethylene glycol, of molecular weight — 200, 300, 400, 600, 1500, and 6000, was reacted with one mole of trimellitic anhydride to prepare six partial esters of increasing molecular weight. Similarly, polyethylene glycol, one mole of polyol of molecular weight 600 per mole of di-acid, was reacted with phthalic anhydride and maleic anhydride. Two moles of trimellitic anhydride were then reacted with one mole of polyethylene glycol of the following weights — 100, 200, 300, 400, 1500 and 6000 to prepare six additional partial esters of increasing molecular weights.

In each case, the initial product from the reaction was insoluble in water. However, solubility was easily effected with dilute ammonium hydroxide. After dissolution was achieved, the pH of the resulting solution was adjustable to within any desired range without precipitation of the adduct.

EXAMPLE II

The improvement in wettability characteristics of 100% polyester fabric by the process of coating onto the fabric the mono- and diesters of polyethylene oxides and organic dibasic acids is exemplified in the following example. The wettability test used was the AATCC test method 39-1971, Evaluation of Wettability.

The mono- and diesters of trimellitic anhydride, phthalic anhydride and maleic anhydride were prepared according to the procedure given in Example I. Monoesters demonstrated a higher degree of wettability than the diesters. The incorporation of a 1% level of add-on improved the wettability properties, but higher add-on, a 5% level, did not perform better than the 1% level. The comparative wettability performance of the 600-polyethylene glycol adducts of TMA, PAN, and MAN indicated 600-TMA-1 gave better wettability than did 600-PAN-1, which, in turn, gave better wettability than did 600-MAN-1. It is not reasonable to ascribe any reasons for this behavior at this time, although it can be theorized that the performance of the aromatic based materials is superior to the aliphatic materials because they form a more stable bond to the surface of the fiber than do the aliphatics, or the aromatics based materials are more resistant to hydrolysis, or the extra carbonyl group in the TMA unit provides an increased degree of hydrophilicity. As shown in Table I, the preferred ester for hydrophilicity is 1-TMA-1500.

The sample swatches were prepared in the following method. The places of spun woven 100% polyester fabric, 15 × 15 in. (38 × 38 cm) were weighed on the nearest 100th gram. The fabrics were then submerged in the 1% finishing bath which is described in Example I. After insuring that a complete wetout had occurred, the fabrics were then put through a standard padder (consisting of two rubber rolls) and the excess pad solution squeezed from the fabrics. Normally a wet pickup of 100% was achieved of the 1% active finishing bath. After padding, the wet fabrics were stretched over tenter frames and placed in a drying oven at 120° C. for a period of five minutes. The dried fabrics were then cured for an additional five minutes at 150° C.

The wettability test was run on fourteen swatches of 100% polyester fabric which had been finished according to the treating process utilizing 1% and 5% finishing baths, dried for five minutes and cured for five minutes. The sample swatches were then subjected to five standard wash cycles of 12 minutes each with AATCC standard detergent. One total rinse, a wash cycle without use of detergent, followed the five washes. The swatches were dried in a Kenmore Model 600 dryer.

Each test swatch was conditioned for 4 hours in a humidity oven at 65 ± 2% relative humidity and 70 ± 2° F. (21 ± 1° C.) and then mounted in an embroidery hoop located beneath a buret. Distilled water was in the buret, temperature 70 ± 5° F. (21 ± 3° C.) The buret was positioned approximately ⅜ inch (1 cm) above the textile swatch. The buret was adjusted to deliver one drop of water approximately every five seconds. Each swatch in the hoop was moved to different positions under the buret so as to receive five drops of water in five different locations. The stop watch was started just as each drop began to fall. The watch was stopped when the liquid on the surface of the swatch lost its specular reflective power. The average time for the five drops upon each sample is set forth in Table I.

Table I

Evaluation of Wettability-100% Polyester Fabric
AATCC test 39-1971

| Sample | % Active Coated | Time to Disappear In Seconds-Avg. of Five Readings |
|---|---|---|
| Control | — | 1500 |
| 400-TMA-1 | 1 | 205.2 |
| 400-TMA-2 | 1 | 600.6 |
| 600-TMA-1 | 1 | 122.4 |

Table I-continued

| Evaluation of Wettability-100% Polyester Fabric AATCC test 39-1971 | | |
|---|---|---|
| Sample | % Active Coated | Time to Disappear In Seconds-Avg. of Five Readings |
| 600-PAN-1 | 1 | 171.8 |
| 600-MAN-1 | 1 | 354.7 |
| 1500-TMA-1 | 1 | 23.8 |
| 1500-TMA-2 | 1 | 565.6 |
| 400-TMA-1 | 5 | 50.7 |
| 400-TMA-2 | 5 | 46.8 |
| 600-TMA-1 | 5 | 47.6 |
| 600-PAN-1 | 5 | 116.5 |
| 600-MAN-1 | 5 | 104.8 |
| 1500-TMA-1 | 5 | 31.5 |
| 1500-TMA-2 | 5 | 61.4 |

EXAMPLE III

Fourteen swatches of 100% polyester fabric were prepared as in Example II and were subjected to a wicking behavior test. Each swatch was ten inches long and cut in the warp direction of the fabric at a width of 1 ½ inches (3.8 cm). A loop was sewn in one end of each strip of fabric large enough so that a 1 ½ inch rod ¼ inch in diameter weight 2.0 grams could be inserted. Each piece of fabric was then suspended from a rod and immersed to a depth of one inch above the thread line of the loop in a solution of distilled water and 1.0% household blueing, which was added to aid in detection of the wicking level. Each swatch of fabric was allowed to remain in the blueing solution for 45 minutes. At the end of this period, the swatch was removed from the solution and the level to which the water had wicked up the fabric was measured in centimeters. The higher the wicking level, the greater the hydrophilicity of the fabric finish.

The mono- and diesters of TMA, PAN, and MAN demonstrated hydrophilic activity on the surface of the 100% polyester fabric when durably set on the surface of the polyester fiber. Mono adducts of the polyethylene oxide units demonstrated a higher level of wicking (and hydrophilicity) than did the diester. The incorporation of a 1% active level onto the coated material improved the hydrophilic properties of the fiber. Higher add-on did not appear to increase the hydrophilic properties of the fiber significantly beyond the 1% level. In terms of the hydrophilization of a polyester fiber, the attachment of a molecular weight polyethylene glycol of approximately 1500 was found to be preferred. A comparison of the 600 molecular weight adducts of TMA, PAN, and MAN indicated that the TMA monoester increased hydrophilicity more than did the PAN and MAN monoesters. The wicking results are set forth in Table II.

Table II

| Evaluation of Wicking-100% Polyester Fiber | | |
|---|---|---|
| Sample | % Active Coated | Wicking Weight In Or In 45 Minutes |
| Control | 0 | 6.1 |
| Control | 0 | 6.0 |
| Control | 0 | 6.2 |
| 400-TMA-1 | 1 | 9.4 |
| 400-TMA-2 | 1 | 7.5 |
| 600-TMA-1 | 1 | 11.3 |
| 600-PAN-1 | 1 | 9.9 |
| 600-MAN-1 | 1 | 9.2 |
| 1500-TMA-1 | 1 | 14.5 |

Table II-continued

| Evaluation of Wicking-100% Polyester Fiber | | |
|---|---|---|
| Sample | % Active Coated | Wicking Weight In Or In 45 Minutes |
| 1500-TMA-2 | 1 | 7.1 |
| 400-TMA-1 | 5 | 14.0 |
| 400-TMA-2 | 5 | 12.5 |
| 600-TMA-1 | 5 | 14.9 |
| 600-PAN-1 | 5 | 12.2 |
| 600-MAN-1 | 5 | 12.0 |
| 1500-TMA-1 | 5 | 14.4 |
| 1500-TMA-2 | 5 | 12.0 |

EXAMPLE IV

The durability of the anti-soiling and soil release finish which withstands repeated washings and dry-cleanings by the invented process of coating onto the polyester fabric the described mono- and diesters is set out in the following example. The AATCC standard soil release test Method 130-1970 was used to evaluate the effectiveness of the soil release coating. The test swatches were laundered first five times (5X) in a Kenmore automatic washing machine Model 600 using standard cycle times of 12 minutes with detergent plus one complete cycle without detergent. The detergent was AATCC standard detergent.

Seven TMA-Carbowax 600 adduct test swatches of 100% polyester fiber were prepared according to the procedure of Example I and run with five polyester control swatches. Treating level was 1% solids owg. Each test swatch was placed flat upon a single thickness of AATCC Textile Blotting Paper on a smooth horizontal surface. Using a medicine dropper, five drops (ca. 0.2 ml.) of "Nujol" brand mineral oil (mustard, tobasco, etc.) were placed in the approximate center of the test swatch. A 3 × 3 in. (7.6 × 7.6 cm) square of glassine paper was placed over the oil puddle (mustard, tobasco, etc.) and a five-pound weight was placed over the paper, being allowed to sit there undisturbed for one minute. The weight was removed and the test swatch was washed within 15–60 minutes after staining.

The washing procedure utilized a Kenmore Automatic Washer Model 600, and a Kenmore Automatic Dryer Model 600. The washer was filled with water at a temperature of 120 ± 15° F. (49 ± 8° C.), 140 ± 5 grams of AATCC Standard Detergent 124 were added. Test specimens and ballast were added to the washer to make a total load of 4.00 ± .25 lbs. The normal wash run of 12 minutes was completed. After the spin cycle, the entire load, with ballast, was placed into the dryer. Dryer temperature was 160 ± 10° F. (70 ± 6° C.) maximum stack temperature for 45 ± 5 minutes. Residual stains were rated after drying, within the four hour rating period required.

The dry-cleaning procedures utilized were those of a commercial establishment with perchloroethylene as the dry-cleaning solvent. The test swatches were dry-cleaned in 4.00 ± 0.25 lb. lots by a commercial dry-cleaning establishment. Each dry-cleaning was counted as one cycle.

The effect of the TMA-Carbowax 600 finish upon the soil release properties of the 100% polyester fabric is set forth in Table III. The durability of the anti-soiling finish imparted by the treating and coating process is significantly demonstrated.

TABLE III

Evaluation of Soil Release-100% Polyester
1% Solids owg

| Treatment | Cycles Laundered/Dry Cleaned | Nujol Oil | Mustard | Tobasco | Chocolate Syrup | Grape Juice | Transmission Fluid | Motor Oil |
|---|---|---|---|---|---|---|---|---|
| Control | 1/10 | 2.0 | 3.5 | 1.5 | 4.0 | 4.0 | 1.0 | 1.0 |
| 600-TMA-1 | 1/0 | 4.0 | 3.5 | 4.0 | 4.0 | 2.0 | 3.0 | 3.0 |
| Control | 6/0 | 2.0 | 3.5 | 1.5 | 4.5 | 4.2 | 1.5 | 1.5 |
| 600-TMA-1 | 6/0 | 4.0 | 4.0 | 4.0 | 4.0 | 3.5 | 4.0 | 4.0 |
| Control | 25/0 | 1.5 | 3.0 | 2.0 | 4.0 | 3.0 | 1.0 | 1.0 |
| 600-TMA-1 | 25/0 | 4.0 | 4.0 | 3.5 | 4.0 | 4.0 | 1.5 | 1.5 |
| Control | 50/0 | 2.5 | 3.5 | — | — | 4.5 | — | — |
| 600-TMA-1 | 50/0 | 4.0 | 4.0 | — | — | 5.0 | — | — |
| Control | 25/0 | 1.5 | 3.0 | 2.0 | 4.0 | 3.0 | 1.0 | 1.0 |
| 600-TMA-1 | 25/1[a] | 3.5 | 3.0 | 3.0 | 4.0 | 3.0 | 3.0 | 3.0 |
| 600-TMA-1 | 25/4[a] | 4.0 | 3.0 | 3.0 | 4.5 | 4.0 | 3.0 | 3.0 |
| 600-TMA-1 | 25/9[a] | 4.5 | 3.0 | 3.5 | 4.5 | 3.0 | 3.0 | 3.0 |

[a]Subjected to 20 laundry cycles, then dry-cleaned, then 5 additional laundry cycles

EXAMPLE V

The process of coating phthalic anhydride (PAN) and maleic anhydride (MAN) esters of Carbowax 600, prepared and coated onto 100% polyester fabric according to the procedures of Examples I and II was evaluated by comparison with the anti-soiling results of coating TMA-Carbowax 600 onto 100% polyester fabric as in Example III. The test results as set forth in Table IV indicate the coating process utilizing PAN and MAN esters is approximately equally effective in developing anti-soiling properties and when utilizing TMA esters.

TABLE IV

Soil Release Ratings on 100% Polyester
1% Solid owg

| Treatment | Washes | Nujol | Mustard | Tobasco | Chocolate Syrup | Grape Juice | Transmission Fluid | Motor Oil |
|---|---|---|---|---|---|---|---|---|
| Control | 1 | 2.5 | 3 | | | 4 | | |
| 1%-600-PAN-1 | 1 | 4.5 | 3 | | | 3 | | |
| Control | 7 | 2 | 3 | | | 4 | | |
| 1%-600-PAN-1 | 7 | 4.5 | 3 | | | 3.5 | | |
| 2%-600-MAN-1 | 6 | 4 | 3 | | | 3.5 | | |
| Control | 25 | 1.5 | 2.5 | 4 | 4 | 4 | 1 | 1 |
| 1%-600-PAN-1 | 25 | 4.5 | 3 | 3.5 | 4 | 4 | 3 | 3 |
| 2%-600-MAN-1 | 25 | 4 | 3.5 | 3 | 4 | 3.5 | 1.5 | 2 |
| Control | 50 | 1.5 | 3 | 1.5 | 4 | 2.5 | 1 | 1 |
| 1%-600-PAN-1 | 50 | 4.5 | 3 | 2 | 4.5 | 4.5 | 1 | 1 |
| 2%-600-MAN-1 | 50 | 4.5 | 3 | 1.5 | 4.5 | 4.5 | 1 | 1 |

EXAMPLE VI

The mono- and diesters of TMA, diethylene glycol and Carbowax 200 through 1500, prepared according to the procedure of Example I and coated onto 100% polyester fabric according to Example II, were tested as to soil release activity. The results indicated that soil release activity became significant at the 400 molecular weight level on 100% polyester fabric. Solids level on the test swatches was 1% and 4% (owg). The pH's of the coating process bath were 5.5 and 9.5. Restaining was per the original staining procedure.

No advantage in soil release activity was determined between 1% and 4% solids (owg). The pH of the coating process treatment was determined as not being critical. Both pH levels provided fabric with excellent soil resistant properties. The effect on soil release performance is set forth in Table V using Nujol and mustard stains.

A separate evaluation of the monoester of TMA and Carbowax 6000 prepared according to the procedure of Example I and coated onto 100% polyester fabric according to Example II indicated a slight improvement in soil release characteristics of the 6000 molecular weight level versus the control. The data are shown in Table V.

TABLE V

Durability of Soil Release Finish-100% Polyester
100–6000 Molecular Weight PEG

| Sample | Treat % | pH | Nujol 1W | Nujol 5W | Nujol 5-R-1 | Mustard 1W | Mustard 5W | Mustard 5-R-1 |
|---|---|---|---|---|---|---|---|---|
| Control | (No Treatment) | | 2 | 3 | 2.5 | 3 | 5 | 3.5 |
| 100-TMA-2 | 1 | 5.5 | 2 | 5 | 4 | 3 | 5 | 3 |
| | 4 | 5.5 | 3 | 4 | 3 | 4 | 4.5 | 4 |
| | 4 | 9.5 | 2 | 3.5 | 3 | 4 | 4 | 3 |
| 200-TMA-1 | 1 | 5.5 | 4.5 | 5 | 3.5 | 3.5 | 5 | 4 |
| | 4 | 5.5 | 3.5 | 5 | 4.5 | 3.5 | 5 | 3 |
| | 4 | 9.5 | 4 | 5 | 4.5 | 3 | 5 | 3 |
| 200-TMA-2 | 1 | 5.5 | 4 | 5 | 3 | 4 | 5 | 3.5 |
| | 4 | 5.5 | 3.5 | 5 | 4.5 | 3.5 | 5 | 3.5 |
| | 4 | 9.5 | 3 | 5 | 4 | 3 | 5 | 3 |
| 300-TMA-1 | 1 | 5.5 | 3 | 5 | 4.5 | 3.5 | 5 | 3.5 |
| | 4 | 5.5 | 4 | 5 | 4.5 | 3 | 5 | 3 |
| | 4 | 9.5 | 3 | 5 | 4 | 3 | 5 | 3.5 |
| 300-TMA-1 | 1 | 5.5 | 2.5 | 5 | 4 | 3 | 5 | 4 |
| | 4 | 5.5 | 3.5 | 4.5 | 4.5 | 3.5 | 5 | 3 |
| | 4 | 9.5 | 3 | 4.5 | 4 | 2.5 | 5 | 2.5 |
| 400-TMA-1 | 1 | 5.5 | 4.5 | 5 | 4 | 4 | 5 | 3 |
| | 4 | 5.5 | 3.5 | 5 | 4.5 | 3.5 | 5 | 3 |
| | 4 | 9.5 | 4 | 5 | 5 | 3.5 | 5 | 3.5 |
| 400-TMA-2 | 1 | 5.5 | 4 | 5 | 4.5 | 3.5 | 5 | 3.5 |
| | 4 | 5.5 | 3 | 5 | 4.5 | 3.5 | 5 | 3 |
| | 4 | 9.5 | 3 | 5 | 4.5 | 3 | 5 | 3 |
| 1500-TMA-1 | 1 | 5.5 | 3.5 | 5 | 4.5 | 2.5 | 5 | 3.5 |
| | 4 | 5.5 | 4 | 5 | 5 | 3 | 5 | 4.5 |
| | 4 | 9.5 | 4.5 | 5 | 4 | 4 | 5 | 3.5 |
| Control | (No | | — | — | 3 | — | — | 3.5 |
| 600-TMA-1 | 1 | — | — | — | | | | 4 |

1W: 1 Wash
5W: 5 Washes
5-R-1: 5 Washes + restain + 1 wash

EXAMPLE VII

The durability of the anti-soiling finish imparted to 100% polyester fabric by the process of coating mono- and diesters of polyethylene glycol and organic dibasic acid anhydrides over a molecular weight range was demonstrated by subjecting test swatches finished at a 1% (owg) level to a series of washes. Molecular weights of the polyethylene glycol adducts selected were 400 and 1500. Soil release performance was improved up to 58 washes using 400 molecular weight with Nujol oil as the test stain. No improvement was shown on a mustard stain with a 400 molecular weight although the 1500 molecular weight did show a small improvement. A 0.3% 1500 molecular weight finish showed washing durability. The durability of the finishes imparted to the fabric by the coating process is set forth in Tables VI and VII. Comparison of the data in Table III on 600-TMA-1 with the data in Table VI and VII on 400-TMA-1, 400-TMA-2, 1500-TMA-1, and 1500-TMA-2 indicates that the preferred ester for soil release is 600-TMA-1.

Table VI

Evaluation of Soil Release-100% Polyester Fabric
Esters of PEG 400-1% Solid owg

| Sample | Washes | Nujol | Mustard | Grape Juice |
|---|---|---|---|---|
| Control | 1 | 2.5 | | |
| 400-TMA-1 | 1 | 2.5 | | |
| 400-TMA-1 | 1 | 3.5 | | |
| Control | 5 | 3 | | |
| 400-TMA-1 | 5 | 5 | | |
| 400-TMA-2 | 5 | 5 | | |
| Control | 6 | 2.5 | | |
| 400-TMA-1 | 6 | 4.5 | | |
| 400-TMA-2 | 6 | 5 | | |
| Control | 14 | 3.5 | 3.5 | 4 |
| 400-TMA-1 | 14 | 4 | 3 | 3.5 |
| 400-TMA-2 | 14 | 4.5 | 3.5 | 4 |
| Control | 31 | 2 | 3 | 4 |
| 400-TMA-1 | 31 | 3 | 3 | 4.5 |
| 400-TMA-2 | 31 | 3.5 | 3 | 4.5 |
| Control | 56 | 2.5 | 3.5 | 3.5 |
| 400-TMA-1 | 56 | 4.5 | 3.5 | 4.5 |
| 400-TMA-1 | 56 | 4.5 | 3.5 | 4.5 |

Table VII

Evaluation of Soil Release-100% Polyester Fabric
Esters of PEG 1500-1% Solids owg

| Sample | Washes | Nujol | Mustard | Grape Juice |
|---|---|---|---|---|
| Control | 1 | 2 | | |
| 1500-TMA-1 | 1 | 4.5 | | |
| 1500-TMA-1 | 1 | 3.5 | | |
| Control | 7 | 2 | 3 | 4 |
| 1500-TMA-1 | 7 | 3.5 | 3 | 3 |
| 1500-TMA-2 | 7 | — | | |
| Control | 31 | 1.5 | 3 | 4 |
| 1500-TMA-1 | 31 | 4 | 3.5 | 3.5 |
| 1500-TMA-1 | 31 | 4 | 3.5 | 4.5 |
| Control | 56 | 2.5 | 3.5 | 3.5 |
| 1500-TMA-1 | 56 | 4 | 3.5 | 3.5 |
| 1500-TMA-2 | 56 | 4 | 4 | 4.5 |
| 0.3% 1500-TMA-2 | 1 | 4 | 4 | 3.5 |
| 0.3% 1500-TMA-2 | 7 | 5 | 4 | 4 |

EXAMPLE VIII

The mono- and di-trimellitic anhydride esters of diethylene glycol, and Carbowax 200 through 1500, prepared according to the procedure of Example I, were tested to soil release activity on 100% nylon fabric according to the procedure of Example VI. Improved soil release performance was obtained but less improvement was noted on 100% nylon versus 100% polyester due to nylon's inherent soil release properties. No difference in soil release activity was noted between 1% and 4% add-on. The pH of the treatment was not critical. pH levels of 5.5 and 9.5 provided excellent soil release properties. Mustard was not used as a stain as mustard stains cannot be removed from nylon by conventional methods. The results are set forth in Table VIII.

TABLE VIII

Evaluation of Soil Release-100% Nylon Fabric
100-1500 Molecular Weight PEG

| Sample | Treat % | pH | Nujol 1W | 5W | 5-R-1 |
|---|---|---|---|---|---|
| Control | (No Treatment) | | 4 | 5 | 4.5 |
| 100-TMA-2 | 1 | 5.5 | 3.5 | 5 | 4.5 |
| | 4 | 5.5 | 3.5 | 4.5 | 4.5 |
| | 4 | 9.5 | 4 | 4.5 | 4 |
| 200-TMA-1 | 1 | 5.5 | 4 | 5 | 5 |
| | 4 | 5.5 | 4.5 | 5 | 4.5 |
| | 4 | 9.5 | 4 | 5 | 4.5 |
| 200-TMA-2 | 1 | 5.5 | 4 | 5 | 4.5 |
| | 4 | 5.5 | 4 | 5 | 4.5 |
| | 4 | 9.5 | 4.5 | 5 | 5 |
| 300-TMA-1 | 1 | 5.5 | 4.5 | 5 | 5 |
| | 4 | 5.5 | 4 | 5 | 5 |
| | 4 | 9.5 | 3 | 5 | 5 |
| 300-TMA-2 | 1 | 5.5 | 4.5 | 4.5 | 4.5 |
| | 4 | 5.5 | 5 | 5 | 4.5 |
| | 4 | 9.5 | 4 | 5 | 4.5 |
| 400-TMA-1 | 1 | 5.5 | 3 | 5 | 4.5 |
| | 4 | 5.5 | 4 | 5 | 5 |
| | 4 | 9.5 | 4 | 5 | 4.5 |
| 400-TMA-2 | 1 | 5.5 | 4.5 | 5 | 4.5 |
| | 4 | 5.5 | 4 | 5 | 5 |
| | 4 | 9.5 | 3 | 5 | 5 |
| 1500-TMA-2 | 1 | 5.5 | 4.5 | 5 | 4 |
| | 4 | 5.5 | 4.5 | 5 | 4 |
| | 4 | 9.5 | 4 | 4 | 4.5 |

1W: 1 Wash
5W: 5 Washes
5-R-1: 5 Washes + Restain + 1 Wash

EXAMPLE IX

The mono- and diesters of TMA and Carbowax 400, prepared according to the procedure of Example I and coated onto polyester-cotton blends according to Example II, were tested as to soil release activity. The polyester-cotton blends had been treated, prior to the coating bath containing the TMA-Carbowax 400, with a durable press resin, Permafresh 183, at 15% owg level in a one bath application. Permafresh 183 Concentrate is supplied by Sun Chemical Corporation, Chester, South Carolina. It was prepared by mixing the concentrate with sufficient water to make a 15% solution by weight. Citric acid at a 3% level was substituted as the resin cross-linking catalyst due to the formation of an insoluble magnesium-TMA ester in the presence of the standard catalyst magnesium chloride, $MgCl_2$.

The test results indicated that the presence of the durable press resins overcame the soil-release treatment of the TMA-Carbowax 400 mono- and diesters. No improvement in soil release activity was noted on the durable press resin treated polyester-cotton blends. Solids level on the test swatches was 4% (owg). Fabrics tested were 50/50 and 65/35 polyester/cotton blends. The effect on soil release performance is set forth in Table IX using Nujol and mustard stains.

Table IX

Durability Of Soil Release Finish-Polyester/Cotton
400 Molecular Weight PEG

| Sample | Fabric | Nujol 1W | 5W | 5-R-1 | Mustard 1W | 5W | 5-R-1 |
|---|---|---|---|---|---|---|---|
| Control (No Treatment) | 50/50 | 1 | 4.5 | 2 | 1 | 2 | 1 |
| 400-TMA-1 | 50/50 | 1 | 4.5 | 2 | 1 | 3.5 | 1.5 |
| 400-TMA-2 | 50/50 | 2 | 4.5 | 2 | 1 | 3.5 | 1.5 |
| Control (No Treatment | 65/35 | 1 | 4 | 2 | 2 | 3.5 | 3 |
| 400-TMA-1 | 65/35 | 1 | 5 | 1.5 | 1 | 4 | 3 |

Table IX-continued

Durability Of Soil Release Finish-Polyester/Cotton 400 Molecular Weight PEG

| Sample | Fabric | Nujol 1W | Nujol 5W | Nujol 5-R-1 | Mustard 1W | Mustard 5W | Mustard 5-R-1 |
|---|---|---|---|---|---|---|---|
| 400-TMA-2 | 65/35 | 1 | 5 | 2 | 4 | 4.5 | 2.5 |

1W: 1 Wash
5W: 5 Washes
5-R-1: 5 Washes + Restain + 1 Wash

I claim:

1. A process for treating textiles and textile fibers with a partial ester having at least one retained unreacted acid group on the molecule after the esterification to impart a durable hydrophilic antistatic antisoiling finish which comprises the steps of (1) providing a water soluble reaction product consisting essentially of a polyethylene glycol of an average molecular weight of 100 to 6000 and an aromatic polycarboxylic acid compound selected from the group consisting of trimellitic anhydride, trimellitic acid, pyromellitic dianhydride, pyromellitic acid, phthalic anhydride and phthalic acid wherein the compound is capable of forming a four to six membered cyclic acid anhydride ring, wherein the mole ratios are within the range of 1:1 to 1:2, glycol to acid, the reaction temperature of said glycol and said acid being in the range of from about 130° to 175° C, the said partial esters being characterized by acid numbers within the range of 17 through 286 when said ester is a monoester and 4 through 95 when said ester is a diester, (2) coating, and (3) curing said reaction product on said textile and textile fibers, the said textiles being selected from the group of textiles and textile fibers consisting of polyesters, polyamides and polyester-polyamide blends.

2. The process of claim 1 wherein said acid compounds comprise trimellitic anhydride and trimellitic acid.

3. The process of claim 1 wherein said acid compounds comprise pyromellitic dianhydride and pyromellitic acid.

4. The process of claim 1 wherein said acid compounds comprise phthalic anhydride and phthalic acid.

5. The process of claim 1 wherein said textiles and textile fibers comprise polyesters.

6. The process of claim 1 wherein said textiles and textile fibers comprise polyamides.

7. The process of claim 1 wherein said textiles and textile fibers comprise a polyamide-polyester blend.

8. An article comprising textile fibers and textiles carrying a hydrophilic, antistatic antisoiling finish wherein said finish comprises the application of a partial ester, having at least one retained unreacted acid group, consisting essentially of a polyethylene glycol of an average molecular weight of 100 to 6000 and an aromatic polycarboxylic acid compound selected from the group consisting of trimellitic anhydride, trimellitic acid, pyromellitic dianhydride, pyromellitic acid, phthalic anhydride and phthalic acid having two to four carboxyl groups bonded directly to the aromatic moiety wherein the compound is capable of forming a four to six membered cyclic anhydride ring, wherein the mole ratios are within the range of 1:1 to 1:2, glycol to acid, the reaction temperature of said glycol and said acid being in the range of from about 130° to 175° C, the said partial esters being characterized by acid numbers within the range of 17 through 286 when said ester is a monoester and 4 through 95 when said ester is a diester, the said textile and textile fibers being selected from the group of textiles and textile fibers consisting of polyesters, polyamides, and polyester-polyamide blends.

9. The article of claim 8 wherein said textile fibers and textiles comprise polyesters.

10. The article of claim 8 wherein said textile fibers and textiles comprise polyamides.

11. The article of claim 8 wherein said textile fibers and textiles comprise a polyamide-polyester blend.

12. The article of claim 8 wherein said acid compounds comprise trimellitic anhydride and trimellitic acid.

13. The article of claim 8 wherein said acid compounds comprise pyromellitic dianhydride and pyromellitic acid.

14. The article of claim 8 wherein said acid compounds comprise phthalic anhydride and phthalic acid.

* * * * *

UNITED STATES PATENT OFFICE

CERTIFICATE OF CORRECTION

Patent No. 4,073,993 Dated February 14, 1978

Inventor(s) John C. Lark

It is certified that error appears in the above-identified patent and that said Letters Patent are hereby corrected as shown below:

Column 2, line 54 "were" should be "with"

Column 4, line 39 "hydrophilac" should be "hydrophilic"

Column 9, line 52 "following weights" should be "following molecular weights"

Column 10, line 24 "on the" should be "to the"

Under Table V should be Table V

| | Nujol 5-R-1 | | Nujol 5-R-1 |
|---|---|---|---|
| | 5 | | 5 |
| | 4 | | 4 |
| Control | 3 | Control | 3 |
| 600-TMA-1 | | 600-TMA-1 | 4 |

Signed and Sealed this

Twenty-fourth Day of October 1978

[SEAL]

Attest:

RUTH C. MASON
Attesting Officer

DONALD W. BANNER
Commissioner of Patents and Trademarks